US005562868A

United States Patent [19]

Yost

[11] Patent Number: 5,562,868

[45] Date of Patent: Oct. 8, 1996

[54] CARBURETOR FUEL DISCHARGE ASSEMBLY

[76] Inventor: Robert M. Yost, 10838 Olive St. NW., Coon Rapids, Minn. 55448

[21] Appl. No.: 423,018

[22] Filed: Mar. 16, 1995

[51] Int. Cl.[6] ..... F02M 7/10

[52] U.S. Cl. ..... 261/41.1; 261/44.3

[58] Field of Search ..... 261/34.2, 41.1, 261/16, 18.2, 18.3, 44.3

[56] References Cited

U.S. PATENT DOCUMENTS

| | | | |
|---|---|---|---|
| 1,375,898 | 4/1921 | Ciglia et al. | 261/44.3 |
| 3,007,683 | 11/1961 | McCracken | 261/41.1 |
| 3,066,922 | 12/1962 | Wucherer | 261/41.1 |
| 3,174,469 | 3/1965 | Rappolt | 261/16 |
| 3,957,930 | 5/1976 | Birmingham | 261/44.3 |
| 4,051,815 | 10/1977 | Coberley | 261/18.2 |
| 4,387,689 | 6/1983 | Brown | 261/16 |
| 4,508,189 | 4/1985 | Kato | 261/44.3 |
| 4,524,034 | 6/1985 | Ellison | 261/44.3 |
| 4,957,664 | 9/1990 | Kohno et al. | 261/34.2 |
| 5,223,180 | 6/1993 | Yost | 261/41.1 |

OTHER PUBLICATIONS

Installation Instructions for Mikuni Power Jet Kit.

*Primary Examiner*—Tim R. Miles
*Attorney, Agent, or Firm*—James W. Miller

[57] ABSTRACT

A carburetor has a fuel discharge assembly which is much easier to install than known assemblies. The assembly includes a mounting ring that carries a fuel jet therein with the fuel jet extending radially inwardly relative to the mounting ring. The discharge end of the fuel jet is received in a cylindrical central opening in the mounting ring. The mounting ring is abutted against the side of the carburetor body and is clamped in place by the typical air cleaner assembly that normally abuts to the side of the carburetor body using slightly longer attachment bolts. Thus, the mounting ring is interposed between the inlet end of the airflow passage in the carburetor and the mounting hub of the air cleaner assembly.

12 Claims, 2 Drawing Sheets

CARBURETOR FUEL DISCHARGE ASSEMBLY

TECHNICAL FIELD

This invention relates to a carburetor for supplying atomized fuel, such as gasoline, to a motor vehicle, such as a motorcycle. More particularly, this invention relates to a carburetor having an improved fuel discharge assembly for supplying fuel to the carburetor body which fuel discharge assembly can be quickly and easily installed on the carburetor body.

BACKGROUND OF THE INVENTION

Carburetors are well known devices for mixing gasoline and air together and for supplying this fuel/air mixture to the combustion chambers of an internal combustion engine. Often, the carburetor is used on the engine powering a motor vehicle, such as an automobile or motorcycle, though carburetors are used on non-vehicular internal combustion engines as well. One traditional carburetor is known as the "butterfly" type. This name comes from the shape of the pivotal throttle plate or throttle valve located inside the carburetor body which somewhat resembles a butterfly. Thus, the throttle plate is also sometimes referred to as the butterfly valve.

A butterfly carburetor includes a carburetor body which is secured to the intake manifold of the engine. The carburetor body includes an airflow passage in which incoming atmospheric air is mixed with fuel prior to being admitted to the intake manifold. The throttle plate is located within and generally at the end of the airflow passage which is closest to the intake manifold. A venturi section in the airflow passage is located upstream of the throttle plate. A first fuel jet is located in or adjacent the venturi section so that air passing through the venturi section will draw fuel out of the first fuel jet to mix such fuel with the air flowing through the venturi section. This mixture of atomized air flows past the throttle plate, through the intake manifold, and into the cylinders of the engine, where it is ignited and burned in a known manner.

The amount of fuel and air admitted into the engine is regulated primarily by the operation of the throttle plate. As the operator steps upon or otherwise actuates the throttle, the throttle plate pivots to a more fully open position, increasing the amount of air flowing through the venturi section which correspondingly increases the amount of fuel being sucked out of the first fuel jet. Conversely, pivoting the throttle plate to a more closed position will decrease the total air flow and fuel being supplied from the first fuel jet, to thereby decrease the engine speed. This operation of the throttle plate is sufficient to adequately supply the engine with fuel during idling and cruising operations of the engine.

However, at certain times, additional power is required from the engine. For example, sudden acceleration and high speed operation of the engine requires more fuel than the pivotal throttle plate and first fuel jet combination described above can provide. Accordingly, some carburetors of this type are also provided with a second fuel jet located in the carburetor body for admitting additional fuel to the airflow passage to enrich the mixture and cause the engine to provide more power. Peak engine power is often achieved through testing and by adjusting the relative sizes of the first and second fuel jets.

While carburetors can be purchased with all of the required fuel jet assemblies installed by the original equipment manufacturer, carburetors equipped with only a single fuel jet are far more common. In such cases, kits for installing an additional fuel jet can be bought with the second fuel jet being added to the carburetor by the end user in a retrofit manner. However, the procedure for mounting and installing this fuel jet is both cumbersome and time-consuming. In addition, if the installation procedure is not properly done, then the carburetor itself may be damaged or ruined during the installation procedure, perhaps requiring that it be thrown away and a new carburetor purchased.

In installing additional fuel jets in a carburetor, the common practice is to locate a flat area or boss on the side of the carburetor body in the venturi section of the airflow passage. If no such flat area or boss exists on the carburetor body, one may have to be provided using either a milling machine or a file. Then, two holes have to be drilled into this flat area or boss, with the first hole being sized to receive the fuel jet and the second hole being sized to receive an attachment screw that is located on a mounting arm attached to the fuel jet. The first hole is drilled through the entire thickness of the carburetor body to break through into the venturi section with the second hole being drilled only partway and then being tapped or threaded to receive the attachment screw. The fuel jet is then inserted through the first hole and is held in place by the attachment screw which is tightened into the threaded second hole. This procedure is that used for installing a Mikuni Power Jet Kit to a Mikuni carburetor.

This installation procedure requires specialized tools and some experience and skill on the part of an installer. For example, if the hole that receives the additional fuel jet being installed is not drilled properly, it may ruin the entire carburetor, rendering it unfit for further use, or it may position the fuel jet improperly, leading to decreased performance. In addition, the fuel jet is held in place by only a single attachment screw that is received in a tapped hole that has been drilled by the user. Given the extreme vibrations many of these internal combustion engines experience, particularly at idle, such vibrations tend to loosen the fuel jet and cause leakage of fuel from the carburetor. Any such leakage poses an obvious safety risk.

SUMMARY OF THE INVENTION

One aspect of this invention relates to an improved fuel discharge assembly of the type described above which is much easier for a user to install in a retrofit manner to a carburetor, without requiring any special tools or to perform any special machining operations on the carburetor body. Another aspect of this invention is to provide such a fuel discharge assembly which will be securely affixed to the carburetor body to resist any tendency to become loose and leak, thus enhancing the safety of the carburetor.

One aspect of this invention is embodied in an improved carburetor for use on an internal combustion engine. The carburetor comprises a carburetor body with an airflow passage formed therein, the airflow passage having an inlet end. A fuel discharge assembly is provided for admitting fuel which is mixed in the airflow passage with air flowing in the airflow passage. The fuel discharge assembly includes a mounting member which may be abutted against the carburetor body thereto such that the mounting member is located immediately adjacent the inlet end of the airflow passage. The mounting member has at least one fuel jet carried thereon. An air cleaner assembly is abutted against the other side of the mounting member and secured to the carburetor body by attachment means such that the mounting member is clamped to the carburetor body by the air cleaner assembly to be interposed between the carburetor body and the air cleaner assembly when the air cleaner assembly is in place.

BRIEF DESCRIPTION OF THE DRAWINGS

This invention will be described hereafter in the Detailed Description, taken in conjunction with the following drawings, in which like reference numerals refer to like elements or parts throughout.

DETAILED DESCRIPTION

Figure 1:
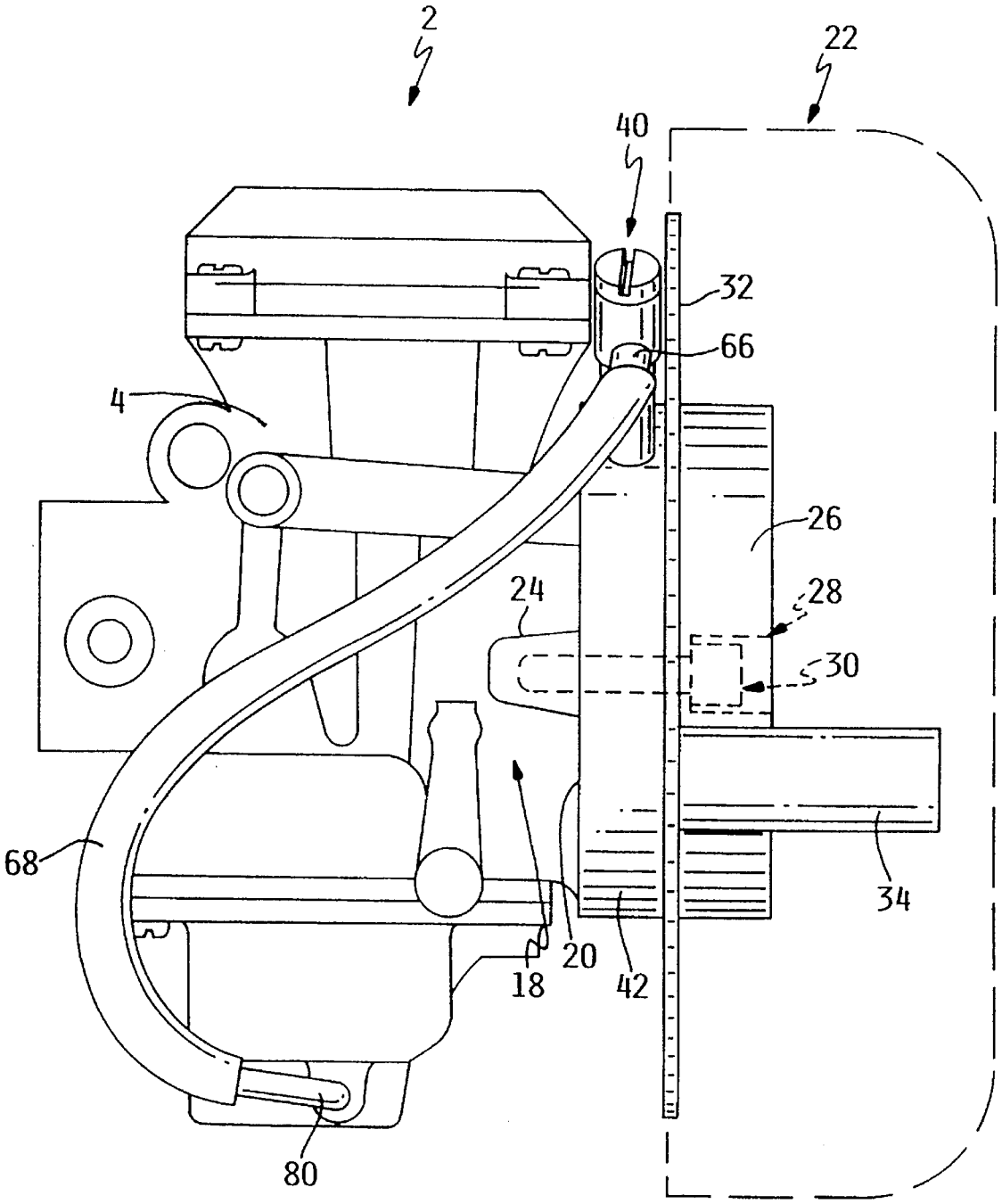
FIG. 1 is a side elevational view of a carburetor of the type to which this invention relates, illustrating the fuel discharge assembly which includes a ring shaped mounting member used to mount the fuel jet to the carburetor between the carburetor body and the typical air cleaner assembly.
Figure 3:
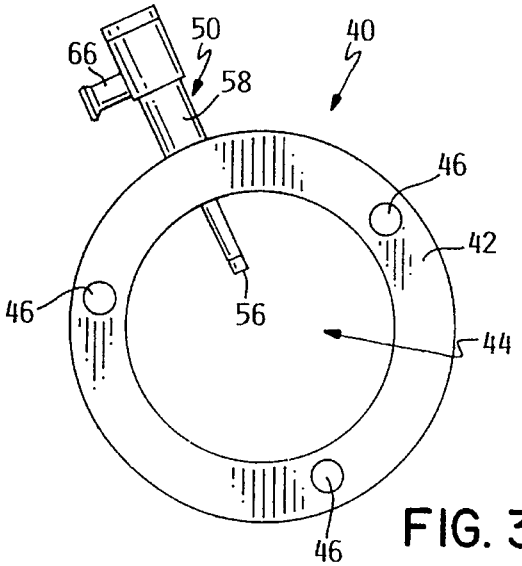
FIG. 3 is a top plan view of the fuel discharge assembly shown in FIG. 1.

Referring to FIG. 1, a carburetor of the "butterfly" type is generally identified as 2. Carburetor 2 is used on internal combustion engines. Details concerning the structure and operation of butterfly type carburetors are well known to those skilled in the art. Accordingly, the structure and operation of carburetor 2 will be described in this application only insofar as is necessary to an understanding of this invention.

Figure 2:
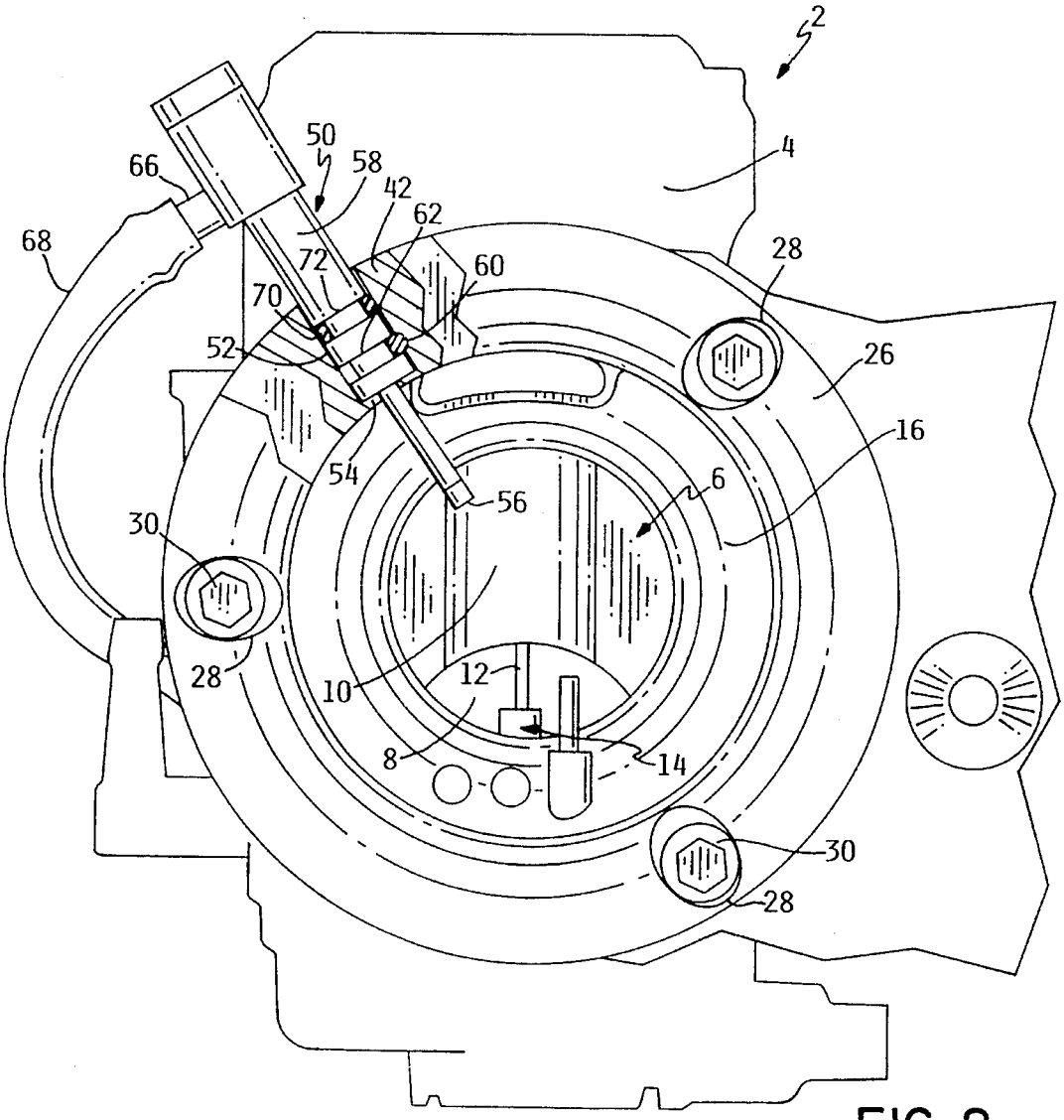
FIG. 2 is an end view of the fuel discharge assembly shown in FIG. 1, particularly illustrating the fuel jet received in its ring shaped mounting member with the mounting member being affixed to the carburetor body in an abutting relationship to the inlet end of the airflow passage.

Referring again to FIG. 1, carburetor 2 includes a carburetor body 4. Carburetor body 4 has a longitudinal airflow passage 6 which is shown in FIG. 2 with its inlet end facing the viewer and its opposite end being the outlet end (i.e. that end of passage 6 which delivers the fuel to the combustion chamber(s) of the engine or an intake manifold connected to such chambers). A pivotal throttle plate 8, also known as the "butterfly valve", is mounted near the outlet end of airflow passage 6. Throttle plate 8 may be pivoted by operation of the throttle from a fully open position where the throttle plate is parallel to the airflow passage 6 to obstruct the passage 6 the least to a fully closed position where the throttle plate extends across passage 6 to completely block or close airflow passage 6.

In addition, carburetor body 4 as shown herein includes a vertically reciprocal slide member 10, slidable on a rod 12, that also controls fuel flow through the airflow passage 6. Together, slide member 10 and throttle plate 8, which in FIG. 2 is behind slide member 10 so that only a lowermost portion of throttle plate 8 is shown, control the amount of fuel delivered to the internal combustion engine to which carburetor 2 is mounted. Almost all carburetors 2 of this type will include pivotal throttle plate 8, but slide member 10 may or may not be used in carburetor 2.

Referring again to FIG. 2, carburetor 2 includes a first fuel jet 14 secured to the airflow passage 6 in the venturi section 16 thereof, i.e. that portion of airflow passage 6 in advance of slide member 10 and throttle plate 8 and near the inlet end of passage 6. This fuel jet 14 will spray fuel into airflow passage 6 during operation of the engine, with the fuel being sucked out of the fuel jet by the venturi action in venturi section 16 of the carburetor. This fuel will mix with the air entering into and flowing through airflow passage 6 such that this air-fuel mixture is then delivered to the engine at the outlet end of airflow passage 6, i.e. the far end in FIG. 2 behind throttle plate 8. To this point, the recitation of carburetor 2 is that of a conventional prior art carburetor.

Referring to FIG. 2, the inlet opening of air flow passage 6 is formed in one side 18 of carburetor body 4 in a planar face 20 of carburetor body 4, this inlet opening forming the beginning or being close to the beginning of the initial narrowing in venturi section 16. Normally, an air cleaner assembly 22 is releasably fixed or secured to the side 18 of carburetor body 4 in an abutting relationship to the inlet opening to air flow passage 6.

A number of threaded bosses 24 are formed on the exterior of carburetor body 4 surrounding the inlet opening to air flow passage 6. Air cleaner assembly 22 includes a mounting hub 26 having a number of holes 28 that correspond to the number of threaded bosses 24 in carburetor body 4. A similar number of machine bolts 38 are used to bolt hub 26 of air cleaner assembly 22 to the side 18 of carburetor body 4, with one bolt 30 passing through each hole 28 in hub 26 and into one of the threaded bosses 24 on carburetor body 4. Thus, the air being admitted to airflow passage 6 in carburetor body 4 is first filtered and cleaned by air cleaner assembly 22 in a known manner.

Air cleaner assembly 22 includes an annular plate 32 having a number of spaced, threaded posts 34 located around mounting hub 26. The outside housing or canister (not shown) of air cleaner assembly 22, which carries the replaceable air filter element, is removably attached by screws or bolts to such posts 34, to allow replacement of the air filter element without removing the entire air cleaner assembly 22 from carburetor 2. However, the precise structure of air cleaner assembly 22, and its particular method of attachment to carburetor body 4, is not important to this invention as long as air cleaner assembly 22 is somehow clamped to carburetor body 4 in an abutting relationship to the inlet opening and inlet end of airflow passage 6. Thus, the use of threaded attachment bolts 30 could be replaced with any other known clamping means that would be effective for securing air cleaner assembly 22 to carburetor body 4.

This invention relates to a new structure for mounting additional fuel jets to carburetor 2 and comprises the fuel discharge assembly generally identified as 40. Fuel discharge assembly 40 includes an annular mounting ring 42 having a central cylindrical opening 44 therethrough. Opening 44 is approximately the same diameter as the inlet opening to airflow passage 6 in carburetor body 4 and mounting ring 42 has a size and shape that corresponds with the annular flange shape of carburetor body 4 immediately around the inlet opening to airflow passage 6. Mounting ring 42 also has a size and shape similar to that of mounting hub 26 of air cleaner assembly 22.

Mounting ring 42 is adapted to be secured to carburetor 2 between the inlet end of airflow passage 6 and air cleaner assembly 22. In other words, the air cleaner assembly 22 that is typically bolted to the side of carburetor body 4 is removed, mounting ring 42 is then abutted against the side 18 of carburetor body 4 with the opening 44 therein being coaxially aligned with the inlet opening of airflow passage 6, and then the air cleaner assembly 22 is now re-installed in an abutting relationship to the other side of mounting ring 42. In effect, mounting ring 42 is clamped between carburetor body 4 and air cleaner assembly 22.

Mounting ring 42 is held in place by the same attachment bolts 30 used to secure air cleaner assembly 22 to carburetor body 4, though the length of bolts 30 will have to be increased to accommodate the extra thickness of mounting ring 42. Mounting ring 42 includes a set of circumferentially spaced holes 46 that will be aligned with the threaded bosses 24 in carburetor body 4 and with holes 28 in hub 26 of air cleaner assembly 22 so that the attachment bolts 30 used to secure air cleaner assembly 22 to carburetor 2 will also pass through mounting ring 42. See FIG. 1. Thus, when attachment bolts 30 are tightened in hub 26 of air cleaner assembly 22, mounting ring 42 will be rigidly clamped to the side of carburetor body 4 immediately adjacent to and in an abutting relationship with the inlet end of airflow passage 6. The use of multiple spaced attachment bolts 30, and the clamping nature of the engagement between mounting ring 42 and carburetor body 4, will ensure that mounting ring 42 is securely mounted thereon and is not likely to become loose, even given the nature of the vibrations experienced during operation of the engine.

Fuel discharge assembly 40 includes an additional fuel jet 50 which is received in a radially extending recess or pocket 52 provided or machined in the circumference of mounting ring 42. This pocket 52 has a closed inner end 54 with a small opening through which the nozzle tip 56 of fuel jet 50 enters into cylindrical opening 44 in the interior of mounting ring 42. The enlarged body 58 of fuel jet 50 simply abuts against the inner closed end 54 of pocket 52 after nozzle tip 56 of fuel jet 50 passes therethrough. When so inserted, fuel jet 50 is oriented generally radially with respect to cylindrical opening 44 of mounting ring 42, and thus with respect to airflow passage 6, to allow fuel to be sprayed into the air stream entering airflow passage 6. However, the orientation of fuel jet 50 need not be along a strictly radial line, i.e. fuel jet 50 could be arranged to have different non-radial orientations to cylindrical opening 44 and airflow passage 6.

Some means is provided for fixing and holding fuel jet 50 in place in mounting ring 42. One preferred means is a roll pin 60 received in an annular groove 62 in body 58 of fuel jet 50, roll pin 60 being inserted through one face of mounting ring 42 after fuel jet 50 is placed into pocket 52. Roll pin 60 is forced into mounting ring 42 by pounding it in or by otherwise forcing it into place. In any event, once roll pin 60 is inserted therein, it will prevent fuel jet 50 from being dislodged or removed. In addition, the engagement of roll pin 60 with groove 62 allows fuel jet 50 to be rotated about a longitudinal axis therethrough, e.g. the axis 64 shown in FIG. 2, so that a hose connecting nipple 66 on the upper end of fuel jet 50 can have its orientation adjusted relative to carburetor body 4. This may be necessary to more conveniently locate the fuel supply hose 68 for fuel jet 50.

While roll pin 60/groove 62 combination has been shown as one way of fixing fuel jet 50 in place, other means could obviously be used. For example, fuel jet 50 could be glued in place or fixed in place inside pocket 52 in a non-adjustable fashion.

In order to prevent any leakage of fuel from fuel jet 50 or mounting ring 42, an O-ring seal 70 is used around fuel jet body 58 between the outer diameter of body 58 and the inner diameter of pocket 52. This O-ring seal 70 is located in an additional groove placed in fuel jet body 58 above the level of roll pin groove 62. Thus, any fuel that might inadvertently try to pass or leak out around fuel jet 50 will be sealed in place.

Fuel jet assembly 40 further includes a fuel supply hose 68 as noted above that extends to nipple 66 on the top end of fuel jet 50. The other end of such hose 68 is connected to a suitable source of fuel, for example a fuel supply nipple 80 located on carburetor body 4 in the float bowl portion thereof. This fuel supply nipple 80 can be one that is provided thereon already by the manufacturer of carburetor 2, e.g. the overflow nipple provided that the internal overflow pipe inside carburetor body 4 is removed to ensure that fuel is always present at nipple 80. Alternatively, hose 68 can be connected to any other suitable source of fuel.

Fuel jet assembly 40 described herein is much easier to install in a retrofit manner than the other known fuel jet assemblies of the prior art. All the user has to do is to remove air cleaner assembly 22, abut mounting ring 42 against that side 18 of carburetor body 4 where air cleaner assembly 22 had been installed (aligning holes 46 in mounting ring 42 to the threaded bosses 24 on carburetor body 4), and then re-install air cleaner assembly 22 using slightly longer attachment bolts 30. Then, the fuel supply hose 68 need only be connected between any fuel suitable fuel supply nipple 80 on carburetor body 4 and nipple 66 on the top end of fuel jet 50. In this regard, fuel jet 50 can be rotated about its own longitudinal axis to allow nipple 66 on the upper end of fuel jet 50 to be located in an optimum orientation to allow convenient routing of fuel supply hose 68 for the particular carburetor at hand. When so installed, the entire fuel jet assembly 40 will be clamped in place in a secure fashion.

Fuel jet assembly 40 may be sold in a kit with fuel jet 50 being pre-installed in mounting ring 42. All of the relatively complicated operations previously required to mount additional or supplementary fuel jets to carburetors are no longer needed. There is no longer any need to machine or file flat areas or bosses on the outside of carburetor body 4, or to drill a hole in carburetor body 4 to receive fuel jet 50, or to drill and tap other holes in carburetor body 4 to receive attachment screws. Thus, fuel jet assembly 40 of this invention can be easily mounted by most anyone without requiring any special tools or expertise.

Fuel jet assembly 40 of this invention is preferably used to mount additional or supplementary fuel jets to a carburetor, e.g. those known as power jets in carburetors used on motorcycles. A first fuel jet 14 is typically already provided inside carburetor body 4 in airflow passage 6. However, mounting ring 42 could be used to install multiple fuel jets 50 if so desired, in which case multiple fuel jets 50 might be located in multiple pockets 52 spaced around the circumference of ring 40.

Various modifications of this invention will be apparent to those skilled in the art. Thus, the scope of this invention is to be limited only by the appended claims.

I claim:

1. An improved carburetor for use on an internal combustion engine, which comprises:

a carburetor body with an airflow passage formed therein, the airflow passage having an inlet air horn;

a fuel discharge assembly for admitting fuel which is mixed in the airflow passage with air flowing in the airflow passage, the fuel discharge assembly including a mounting member which may be abutted against the carburetor body thereto such that the mounting member is located atop the inlet air horn of the airflow passage, the mounting member having at least one fuel jet carried thereon; and an air cleaner assembly abutted against the other side of the mounting member and secured to the carburetor body by attachment means comprising a plurality of fasteners which pass through holes in a predetermined hole pattern in the air cleaner assembly, wherein the mounting member contains a plurality of holes in a pattern which matches the predetermined hole pattern in the air cleaner assembly such that the fasteners used to secure the air cleaner assembly to the carburetor body also pass through the holes in the mounting member such that the mounting member is clamped to the carburetor body by the air cleaner assembly to be interposed between the air horn and the air cleaner assembly when the air cleaner assembly is in place.

2. A carburetor as recited in claim 1, wherein the mounting member includes a central opening therein that is superimposed over the inlet air horn of the airflow passage, and wherein the fuel jet has a discharge tip located within the central opening of the mounting member.

3. A carburetor as recited in claim 2, wherein the fuel jet extends along a radial line to intersect with a longitudinal axis of the central opening in the mounting member.

4. A carburetor as recited in claim 1, wherein the mounting member comprises an annular mounting ring.

5. A carburetor as recited in claim 4, wherein the inlet air horn of the airflow passage has an annular mounting flange with the annular mounting ring being sized to generally correspond to the annular mounting flange of the inlet air horn of the airflow passage.

6. A carburetor as recited in claim 1, wherein the fuel jet is rotatably received in the mounting member to be rotatable about a longitudinal axis passing through the fuel jet to allow a hose connecting means on an upper end of the fuel jet to have its orientation adjusted relative to the carburetor body.

7. A carburetor as recited in claim 6, wherein the fuel jet is held in place in the mounting member by a roll pin, and wherein the roll pin is received in a groove in an outer diameter of the fuel jet to allow the fuel jet to be rotated relative to the mounting member.

8. A carburetor as recited in claim 1, further including means for sealing the fuel jet in the mounting member to prevent any fuel leakage about an exterior surface of the fuel jet.

9. A carburetor as recited in claim 8, wherein the fuel jet is received in a cylindrical pocket in the mounting member, and wherein the sealing means includes an O-ring seal between the exterior surface of the fuel jet and the pocket.

10. An improved carburetor for use on an internal combustion engine, which comprises:

a carburetor body with an airflow passage formed therein, the airflow passage having an inlet air horn;

a fuel discharge assembly for admitting fuel which is mixed in the airflow passage with air flowing in the airflow passage, the fuel discharge assembly including a mounting member which may be abutted against the carburetor body thereto such that the mounting member is located atop the inlet air horn of the airflow passage, the mounting member having at least one fuel jet carried thereon; and an air cleaner assembly abutted against the other side of the mounting member and secured to the carburetor body by attachment means such that the mounting member is clamped to the carburetor body by the air cleaner assembly to be interposed between the air horn and the air cleaner assembly when the air cleaner assembly is in place; and wherein the fuel jet is rotatably received in the mounting member to be rotatable about a longitudinal axis passing through the fuel jet to allow a hose connecting means that is non-parallel to the longitudinal axis located on an upper end of the fuel jet to have its orientation adjusted relative to a fixed fuel source on the carburetor body.

11. A fuel discharge assembly as recited in claim 10, wherein the hose connecting means includes a supply nipple on the upper end of the fuel jet located outside of the mounting member.

12. A fuel discharge assembly as recited in claim 10, wherein the mounting member comprises an annular mounting ring having a cylindrical central opening, and wherein the fuel jet is located in the mounting ring extending radially inwardly relative thereto along a radial line such that a discharge end of the fuel jet is located within the central opening of the mounting ring.

* * * * *